United States Patent [19]

Bozung

[11] Patent Number: 4,515,062

[45] Date of Patent: May 7, 1985

[54] MUSICAL INSTRUMENT HAVING A RIGID BASE WITH CIRCLE OF TONE BARS AND PATTERN GUIDES

[76] Inventor: Richard E. Bozung, Rte. 1, Box 286, Mt. Pleasant, S.C. 29464

[21] Appl. No.: 482,477

[22] Filed: Apr. 6, 1983

[51] Int. Cl.[3] ..... G10D 13/08

[52] U.S. Cl. ..... 84/403

[58] Field of Search ..... 84/402, 403, 404, 405

[56] References Cited

U.S. PATENT DOCUMENTS

| | | | |
|---|---|---|---|
| 2,943,527 | 7/1960 | Hawert | 84/403 |
| 3,456,543 | 7/1969 | Kosuge | 84/404 |
| 3,483,786 | 12/1969 | Heninger et al. | 84/403 |
| 3,641,864 | 2/1972 | Jakubovicz | 84/403 X |

*Primary Examiner*—John Gonzales
*Assistant Examiner*—Douglas S. Lee
*Attorney, Agent, or Firm*—Parkhurst & Oliff

[57] ABSTRACT

A musical instrument comprising a circular rigid base vibrator having a plurality of sound bars arranged in a spaced, circular pattern around the center of the base and on one side of the base, with a pattern guide rotatably mounted coaxially with the base, the pattern guide having openings therein for permitting those bars which sound notes in a diatonic scale or major chord to be struck, while covering or masking other bars whose sounds are not within such scales or chords. The pattern guide is readily interchangeable with similar guides defining other scales or chords.

4 Claims, 5 Drawing Figures

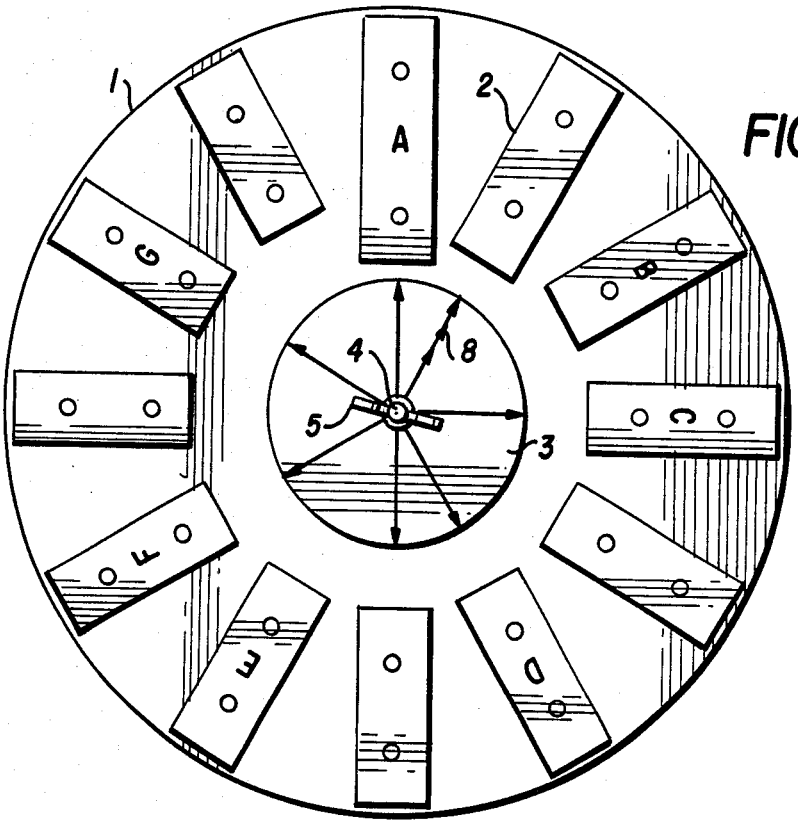
FIG. 1
FIG. 2
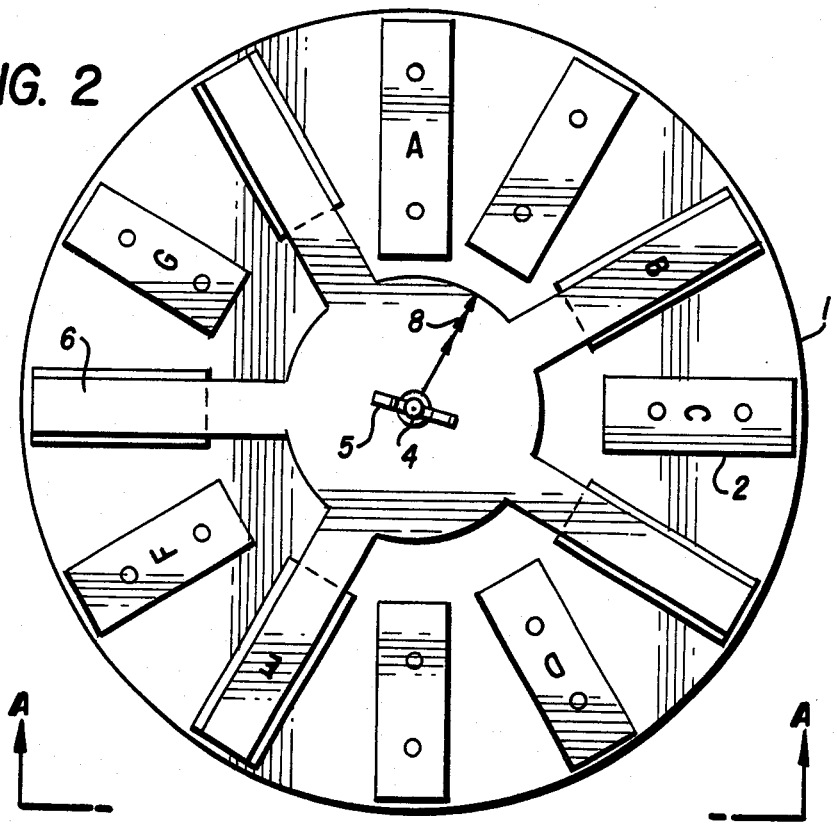

MUSICAL INSTRUMENT HAVING A RIGID BASE WITH CIRCLE OF TONE BARS AND PATTERN GUIDES

BACKGROUND

This invention relates to musical instruments, and more particularly to musical instruments which may be played very simply, and in a selected key, without extensive musical knowledge or instruction.

Western music draws upon the twelve basic sounds of the chromatic scale, but in any given musical composition it typically makes use of only seven of those sounds fitting a particular musical key. If one knows the musical key in which a particular piece is written, and therefore knows the seven sounds associated with that key or scale, he or she may play any of the seven sounds producing counter melodies that harmonize very nicely with the original composition. No music reading or musical experience is necessary as long as one plays with those seven sounds.

An instrument which identified the seven sounds of each of the twelve keys would be an ideal teaching mechanism, as well as being playable by anyone along with music performed by more talented musicians.

BRIEF SUMMARY OF THE INVENTION

This invention comprises a musical instrument with tone bars placed at approximately equal intervals around the periphery of a circle, preferably comprising a minimum of twelve bars, one for each note of the chromatic scale, and fitted with a movable, interchangeable and rotatable pattern guide.

The guides may either point to those bars whose sounds form a particular pattern i.e., a diatonic scale or major chord, or may actually cover or mask those bars, whose sounds do not fit the pattern. The guides are rotatable on a vertical axis through the center of the instrument. Only one guide is used on an instrument at any one time for indicating those sounds that fit the particular pattern. The guide is locked in place to indicate and/or leave open those bars in the particular key or major chord, and can then be disengaged and turned to any of twelve different positions forming any scale or chord pattern or facsimile.

BRIEF DESCRIPTION OF THE SEVERAL VIEWS OF THE DRAWINGS

FIG. 1 is a top view of the instrument of the present invention having a centrally located, movable and turnable guide which points to those bars fitting a particular Western musical pattern, i.e. a diatonic scale or major chord.

FIG. 2 is a top view of the invention instrument with an alternate, removable, internal guide which covers or masks those bars which are not proper parts of a desired pattern.

DETAILED DESCRIPTION

Figure 3:
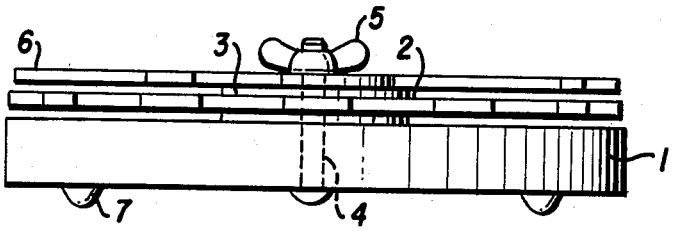
FIG. 3 is a side view from line A—A in FIG. 2, which shows base, bars and the masking guide of FIG. 2 in place.

When indicia of the twelve sounds of the Western chromatic musical scale are spaced about the periphery of a circle, the seven sounds associated with a particular key form a very definitive pattern, i.e., a diatonic scale.

With reference indicia indicating the relative position of the pattern key or all the sounds in the pattern, one can turn the pattern and identify for each key the seven sounds among the twelve which fit the pattern of a desired key. Similarly, other pattern guides can be used which will show the relative positions of sounds forming a major chord or minor chord, or pattern may be used to indicate the relative positions of sounds used in the music of another culture which draws from either a chromatic scale or even some other multi-note base. The guides may be indicia, which turn about the center of a circle with relative positions of the individual note indicia unchanged with respect to each other, thus indicating the sounds that are a part of a particular key. One of the indicia is specially marked as a reference point or key identifier. The guides may also be made in the form of a particular pattern which leaves open those sounds that fit a particular key, and physically prevents one from playing those sounds which are not found in that particular key.

One embodiment of such an instrument is shown in FIG. 1. Twelve tone bars 2 are positioned at desired or equal intervals upon a base 1 in a circular or spiral fashion. At the center of the instrument is a removable, rotatable wheel 3 with indicia 8 forming particular patterns. Different wheels can be placed upon the guide turning bolt 4 by removing the locking mechanism 5 which may be a simple wing nut for removing the wheel, and replacing same with another wheel having a different pattern.

The guide wheel shown in FIG. 1 is a diatonic pattern with a double headed arrow identifying the key note. The pattern in FIG. 1 therefore points to all of the bars that produce sounds in the key or scale of B flat. The guide wheel 3 can be rotated about the vertical axis of the instrument so that with the key arrow pointed to any one of the twelve bars, the other arrows automatically will point to bars whose notes are also found in that key.

FIG. 2 shows a instrument like that of FIG. 1, additionally fitted with a physical masking pattern guide 6 which is supported slightly above the plane of the base by the guide wheel 3. The guide shown in FIG. 2 is also a diatonic pattern and has indicia which at a minimum identify the key location. The arrow in this case is also indicating B flat. The physical masking pattern guide 6 is masking or preventing one from striking those bars which sound notes which are not part of the key or scale of B flat. This guide also turns about a central axis, and in any of twelve positions covers the bars which sound notes which are not part of the key identified by the pointed arrow.

Figure 4:
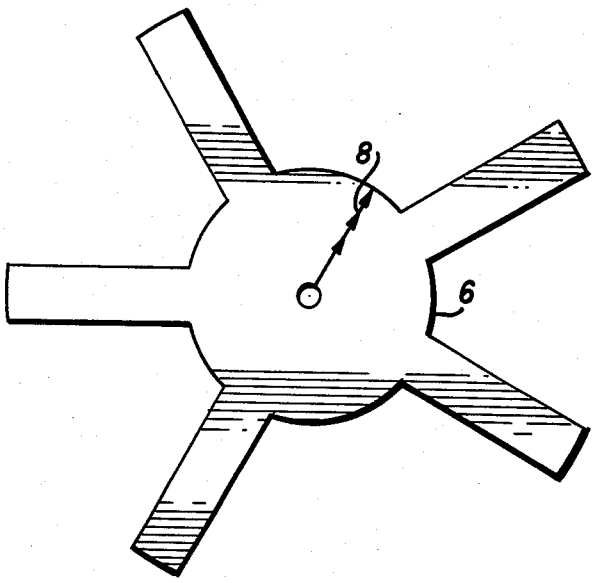
FIG. 4 is a top view of a diatonic masking guide.
Figure 5:
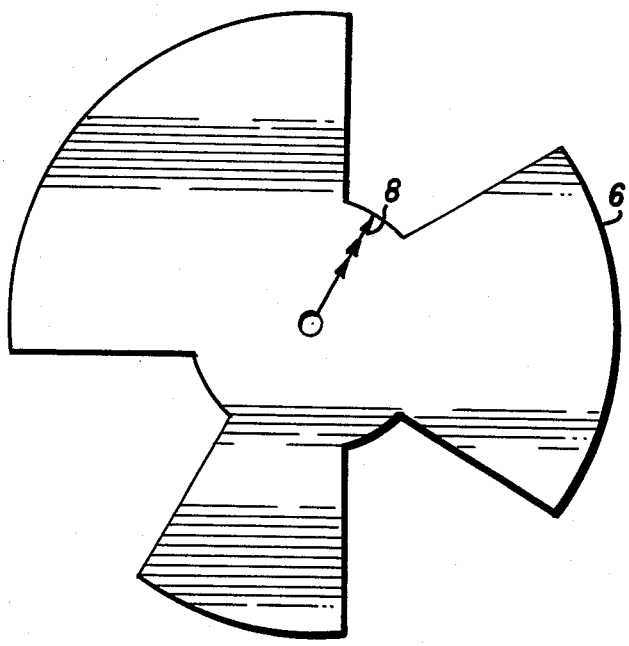
FIG. 5 is a top view of a major chord masking guide.

FIG. 3 is a side view of the instrument from plane A—A showing the several components already identified and base supports 7. The physical masking pattern guide is also removable and interchangeable with other pattern guides. Two such guides are shown. The first is for a diatonic pattern, as shown in FIG. 4, and another is for a major chord pattern, as shown in FIG. 5.

The instrument is played like any rigid vibrator by striking the bars, except that guides have been incorporated into the instrument to point the way or leave open only those bars which produce sounds which fit the particular key, chord, or facsimile. The instrument also may incorporate concentric circles of bars thereby introducing octave ranges and other sounds, or it may include fewer than or greater than twelve bars at spaced intervals corresponding to the base sounds found in another culture.

The pattern guides, which are easily removable, interchangeable and rotatable about a central axis, may be made in any of a wide variety of different musical patterns.

Additionally, the instrument may incorporate electronic bars or some other alternative sounding means in lieu of rigid vibrators.

What is claimed is:

1. A musical instrument comprising a flat base having a plurality of tone generators mounted on one surface of the base, each of said tone generators being mounted along a radius of a circle defined by a center point on the base, the angular distance between radii having tone generators mounted thereon being approximately equal; and a planar pattern guide rotatably mounted coaxially with said circle and in a plane above and substantially parallel to the plane of the base, the pattern guide having notches or openings therein for permitting striking of a selected number of said plurality of tone generators, which selected generators have sounds which are among those in a desired musical scale or chord, said pattern guide otherwise covering the non-selected generators whose sounds are not in the desired musical scale or chord.

2. The instrument of claim 1 additionally comprising a plurality of different pattern guides each of which is interchangeably mountable on the base to permit play of different desired musical scales or chords on the instrument.

3. A musical instrument comprising a flat base having a plurality of tone generators mounted on one surface of the base, each of said tone generators being mounted along a radius of a circle defined by a center point on the base, the angular distance between radii having tone generators mounted thereon being approximately equal; and a circular guide mounted on said base coaxially with the circle of tone generators, said guide having indicia thereon indicating which of said plurality of tone generators have sounds among those in a desired musical scale or chord.

4. The instrument of claim 3 additionally comprising a plurality of different guides each of which bears different indicia and each of which is interchangeably mountable on the base to guide play of different desired musical scales or chords on the instrument.

* * * * *